US008496536B1

(12) United States Patent
McIntosh

(10) Patent No.: US 8,496,536 B1
(45) Date of Patent: Jul. 30, 2013

(54) PUTTER GRIP INSERT FOR READING A GOLF GREEN

(76) Inventor: Eual Ray McIntosh, Benton, KY (US)

( * ) Notice: Subject to any disclaimer, the term of this patent is extended or adjusted under 35 U.S.C. 154(b) by 0 days.

(21) Appl. No.: 13/540,912

(22) Filed: Jul. 3, 2012

Related U.S. Application Data

(63) Continuation-in-part of application No. 12/773,794, filed on May 4, 2010, now Pat. No. 8,231,479.

(51) Int. Cl.
*A63B 69/36* (2006.01)
*A63B 57/00* (2006.01)

(52) U.S. Cl.
USPC ..... 473/226; 473/282; 473/404; 473/409

(58) Field of Classification Search
USPC ..... 473/219, 226, 282, 286, 404, 407, 473/408, 409
See application file for complete search history.

(56) References Cited

U.S. PATENT DOCUMENTS 1,520,113 A * 12/1924 Bloom ..... 473/283
3,364,508 A * 1/1968 Garrett ..... 7/118
5,211,395 A * 5/1993 Liao ..... 473/391
5,377,977 A * 1/1995 MacNeary ..... 473/286
5,409,212 A * 4/1995 Arnett ..... 473/404
5,427,376 A * 6/1995 Cummings et al. ..... 473/201
6,162,137 A * 12/2000 Jones et al. ..... 473/408
6,656,054 B2 * 12/2003 Ulrich ..... 473/201
6,770,000 B2 * 8/2004 Shelley ..... 473/404
8,231,479 B1 * 7/2012 McIntosh ..... 473/226

* cited by examiner

*Primary Examiner* — Nini Legesse
(74) *Attorney, Agent, or Firm* — Waddey & Patterson, P.C.; Ryan D. Levy

(57) ABSTRACT

A blade assembly for a golf putter includes an outer body, a pin, and a blade. The outer body is sized to fit partially within the putter shaft. The pin has a pin shaft and a pin head, each of which have a diameter, and the diameter of the pin head is greater than the diameter of the pin shaft. The blade has a channel sized to receive the pin head. In a first position, the blade extends into the outer body and the putter shaft, substantially parallel to a longitudinal axis of the putter shaft. In a second position, the outer body and pin support the blade at an angle between 15 and 165 degrees to the longitudinal axis of the putter shaft. A golfer can thus use the putter and extended blade as a pendulum and angle finder to read the break of a green.

19 Claims, 11 Drawing Sheets

PUTTER GRIP INSERT FOR READING A GOLF GREEN

CROSS-REFERENCES TO RELATED APPLICATIONS

This application claims benefit of the following patent application(s) which is hereby incorporated by reference: This application is a continuation-in-part of U.S. patent application Ser. No. 12/773,794 (now U.S. Pat. No. 8,231,479), filed May 4, 2010, entitled "Putter Grip for Reading a Golf Green."

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

STATEMENT REGARDING FEDERALLY SPONSORED RESEARCH OR DEVELOPMENT

Not Applicable

REFERENCE TO SEQUENCE LISTING OR COMPUTER PROGRAM LISTING APPENDIX

Not Applicable

BACKGROUND OF THE INVENTION

The present invention relates to a putter for golf, the putter having a unique capability to provide a user an improved method of reading a golf green. In optional embodiments, the putter grip for a putter may include a blade incorporated into the grip to enable a more accurate reading of the golf green as to the degree of break so that a user may better putt the ball in playing the sport.

Golf is a sport utilizing many types of clubs where a player attempts to hit a ball into each hole on a golf course while employing the fewest number of strokes as possible. The primary equipment used in striking a golf ball is a set of golf clubs with each club including a shaft with a grip and a club head on the opposite end of the club. A maximum of fourteen clubs is allowed in a player's possession at one time during a round of golf. Often, golfers change or select different types of clubs based upon their style of play and possibly due to the specific course on which they will play.

One club that is almost always present within a player's bag is a putter which differs from that of the irons or woods which make up the majority of the golf clubs. A putter is generally used from a close distance to the cup typically on a putting green or possibly from the surrounding areas. In today's game of golf the putter is an especially important tool which provides a specific type of ball movement with almost all golfers including one in their bag.

One may describe the act of putting as one of the more precise aspects of the game of golf where a golfer attempts to provide a smooth stroke to launch the ball with relatively little bounce toward the cup on a putting green. Putters may have a variety of different shapes of the club head and furthermore may include a variety of different shaft lengths. For example, lengths of putters include a traditional putter having a 32 to about 35 inch shaft as well as belly putters which generally have a shaft about 6 to 10 inches longer than a normal putter and which are typically anchored against a player's body.

In preparing to make a putt the golfer has to take in certain considerations which include the general speed of the green or putting surface, the general conditions of the putting surface including moisture, divots, bumps, etc. and furthermore also the slope of the putting surface. Often this is considered one of the more challenging tasks and as such a variety of different implements have been created to help golfers make putts more easily. For example, U.S. Pat. No. 4,317,568 issued to Green discloses a golf club with reference plumb marker. Generally, the markers help provide a vertical reference line to approximate the contour of the green by the user. As disclosed in the '568 patent, the golfer grips the golf club loosely at the grip, holding the club at about arm's length in front of the user in a pendulum-like manner so that a vertical line is generally created so that a reference line is provided for reading the contours of a green.

In U.S. Pat. No. 4,824,114 issued to Catalano, a golf putter with slope indicating means therein is disclosed. The putter as disclosed in the '114 patent includes a level means indicating the desired angle at which the putter striking surface should strike the ball and the desired curvature of the path of the ball to the cup. This level means as disclosed in the '114 patent may comprise a pendulum recessed in the putter head or further more may comprise a thin flat dish-shaped housing mounted in a recess in the putter head so that a level indicating device may represent the slope of the green and the desired path for the ball to be represented by color and clearly visible to the user.

Piotrowski et al. discloses in U.S. Pat. No. 6,358,162 a golf putter with green reading features. Generally a putter as disclosed in the '162 patent provides reference lines through the geometric shape of the putter head so that the contours of a green may be more easily read. This may include both a vertical and horizontal reference line formed from the shape of the putter head and shaft so that a golfer has visible reference lines for allegedly reading the contours of the green.

BRIEF SUMMARY OF THE INVENTION

An optional object of the present invention is to provide a putter grip having a blade to provide for an improved reading of the green as to degree of break or slope. Optionally, the putter grip having a blade may provide a user with a lengthy horizontal reference line so that an individual can use the blade and angle it so that the slope of a putting surface can be better approximated.

Yet another optional object of the invention is to provide a putter having a putter grip with a blade incorporated into the grip to provide for a more accurate reading of the green as to the slope and condition of the putting surface.

As used herein a "golf course" or "course" is defined as any place where a golfer may practice, play the game of golf or practice a putting stroke.

Additionally as used herein "green" is defined as a putting surface which may include both artificial and natural materials as well as other practice surfaces and additionally the short grass areas on a course where a user generally putts. Furthermore the terms "hole" and "cup" are used synonymously and it is generally understood to be the place in which a golfer is attempting to get his or her ball into the hole or cup located on the green.

"Slope" as used herein is defined to be a surface deviation of a green from parallel or level. This may include a downhill or uphill direction as well as a contour of the green to a player's left or right or somewhere in between or combination thereof.

"Break" as used herein may refer to the path a putted golf ball may curve generally due to the slope of the green. Break is most often used in reference to a golf ball curving to the left or to the right.

In accordance with the purpose of the invention, as embodied and broadly described herein, the invention includes a putter grip and blade assembly for use with a putter which may be utilized to strike a golf ball into a cup on a green. The putting grip with blade may include a blade that rotates into and out of a recess within the putter grip which may be utilized for evaluating the slope of a green prior to conducting a putting stroke. Additionally, the putter grip with blade may also include other features including tension springs so as to maintain the blade at a specific position whether the position closed with the blade substantially within the recess of the putter grip or out of the recess of the putter grip so that a user can approximate the slope of a green. The putter grip may also include a blade from about 3 inches up to about 6 inches in length so that a user can quickly have a reference line for evaluating the slope of a green. The putter grip with blade may also be utilized for better evaluating the slope in a left to right configuration relative to the golfer and furthermore the golfer may also utilize the putter grip with blade to better estimate whether or not the cup is uphill or downhill from the golf ball.

As used herein the term "read" means to evaluate, obtain information there from, or consider.

According to another optional aspect of the invention, a putter grip with blade assembly may be utilized which may include markings on the blade or the putter grip so that an individual may better ascertain the relative contour of the green based upon the angle of the blade to the putter grip. This may include a combination of both or individually markings on the blade or also on the putter grip itself.

Thus, the putter grip and blade assembly of the present invention in optional embodiments may provide a blade of a variety of different materials including plastics, polymers, metals, alloys or combinations thereof. In further optional embodiments, a recess may be formed within the putter grip so that when the blade is rotated to a closed position, it is substantially within the putter grip. In further optional embodiments, the blade may extend slightly past the exterior surface of the putter grip while in the closed position.

Yet another option aspect of the invention may include pins which may be used for securing the assembly.

An additional optional aspect of the invention may include a blade surface so that when the blade is rotated within the putter grip an almost continuous surface is formed with the exterior of the putter grip and the exterior surface of the blade.

An additional optional aspect of the invention may include a tension device which may comprise a type of spring so that the blade is generally retained within the putter grip unless a user decides to extend the blade out of the putter grip.

Aside from the structural and procedural arrangements set forth above, the invention could include a number of other arrangements, such as those explained hereinafter. It is to be understood that both the foregoing description and the following description are exemplary.

The accompanying drawings are incorporated in and constitute a part of the specification. The drawings illustrate optional embodiments of the invention and together with the description serve to explain some principles of the invention.

BRIEF DESCRIPTION OF THE SEVERAL VIEWS OF THE DRAWINGS

Reference will now be made in detail to optional embodiments of the invention, samples of which are illustrated in accompanying drawings. Whenever possible, the same reference numbers are used in the drawing and in the description referring to the same or like parts.

DETAILED DESCRIPTION OF THE INVENTION

Figure 1:
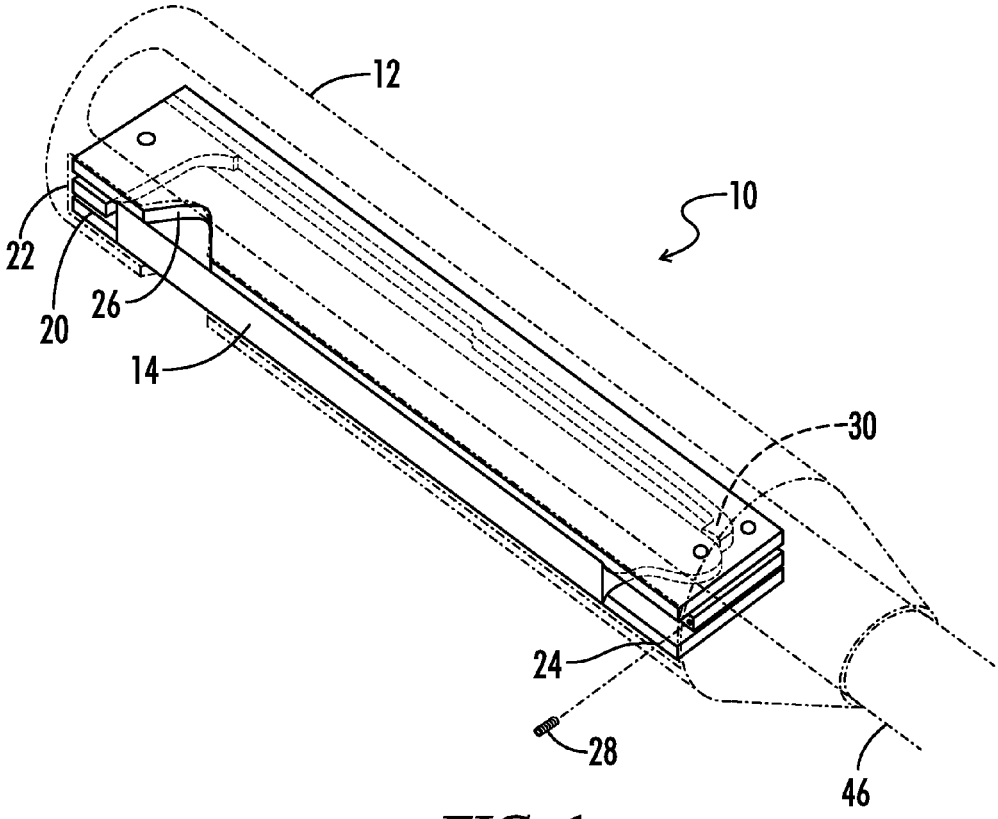
FIG. 1 is a view of an optional embodiment of a putter grip and blade assembly with the blade closed within the putter grip.
Figure 2A:
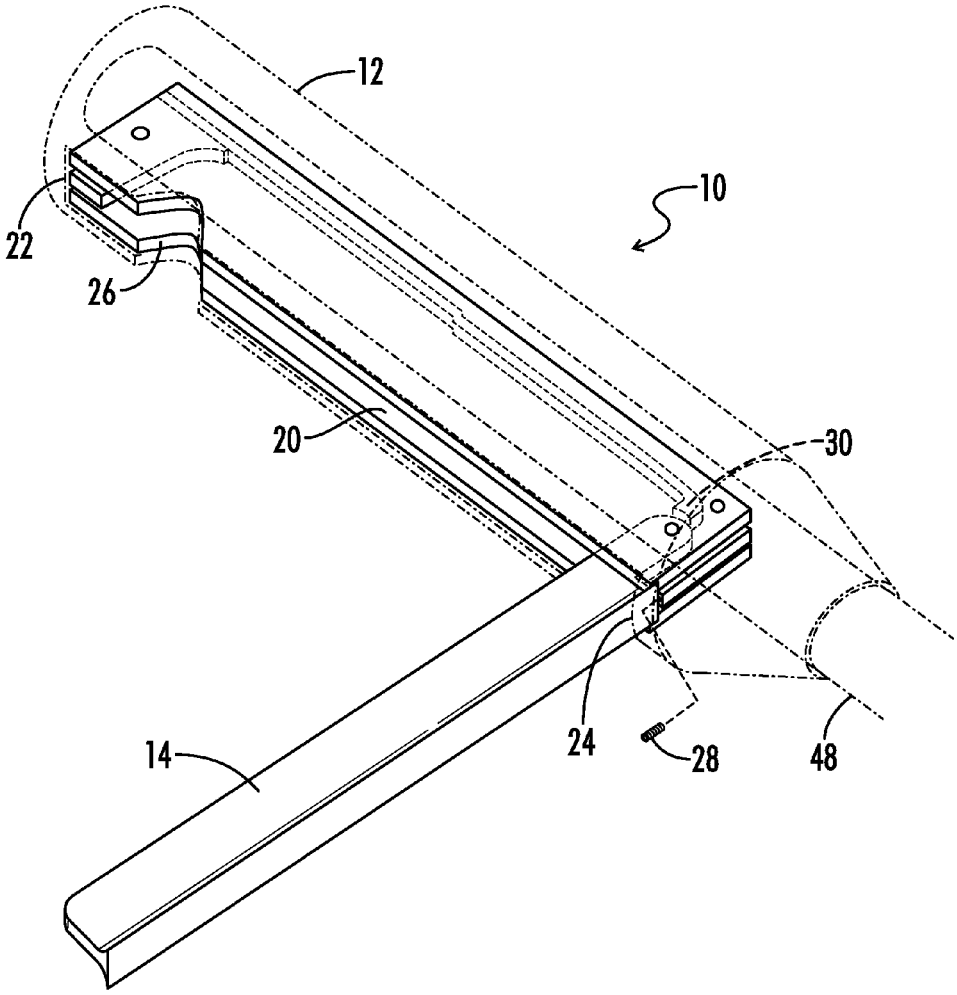
FIG. 2A is a view of an optional embodiment of a putter grip and blade assembly with the blade open.
Figure 2B:
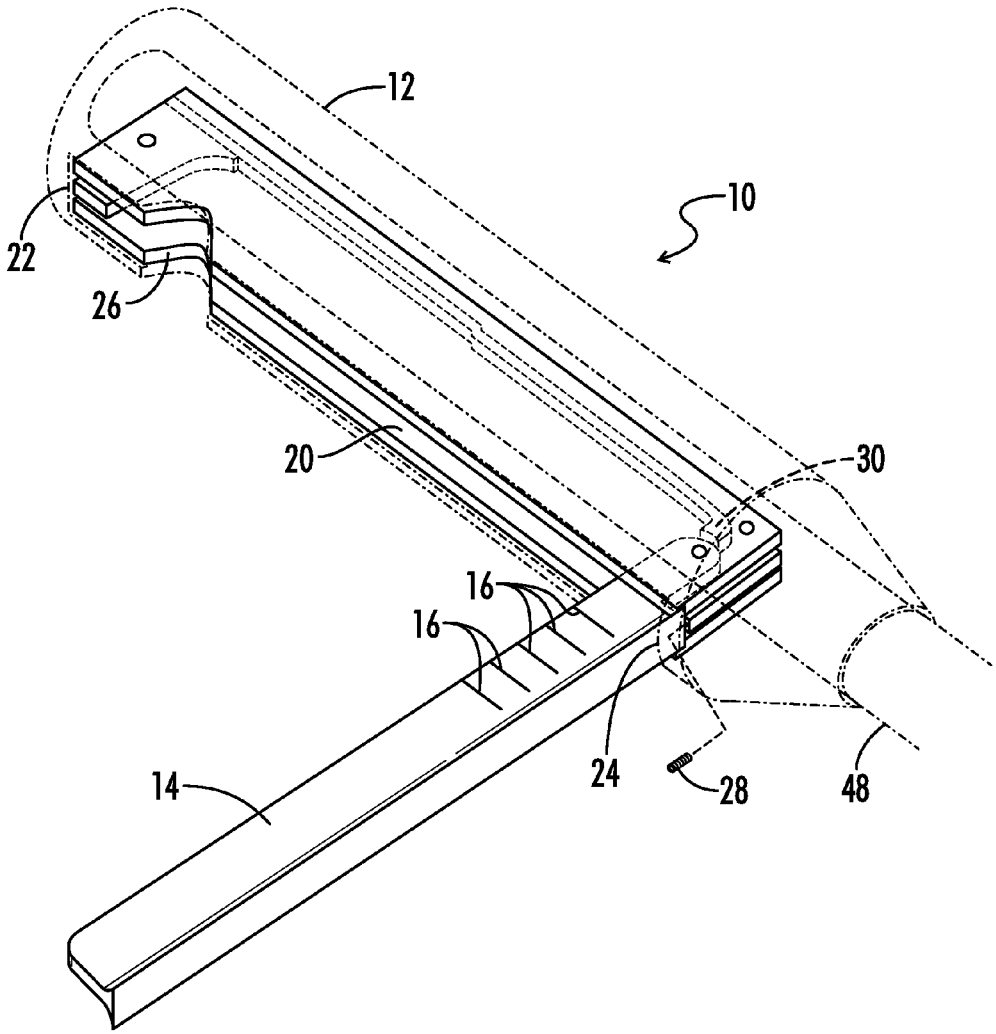
FIG. 2B is a view of an optional embodiment of a putter grip and blade assembly with the blade open.
Figure 2C:
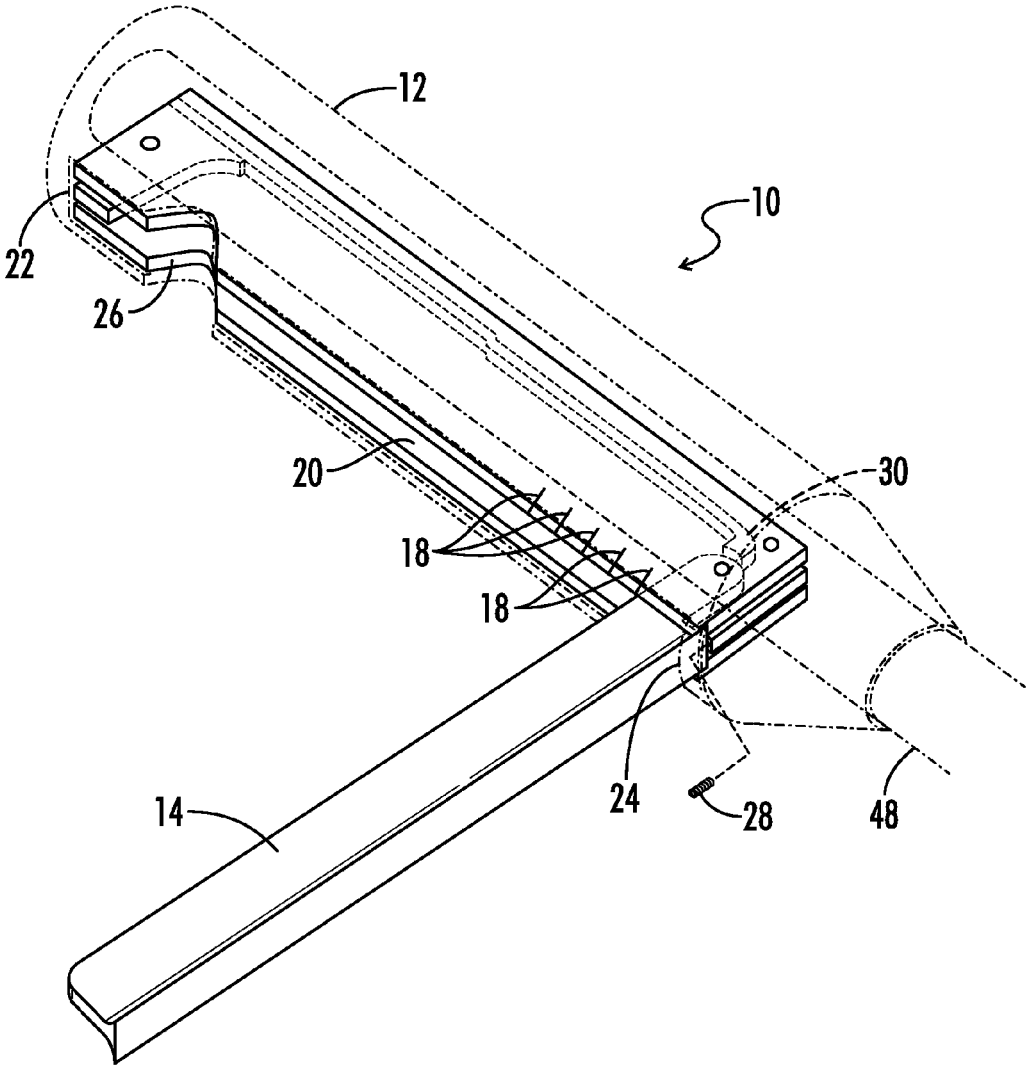
FIG. 2C is a view of an optional embodiment of a putter grip and blade assembly with the blade open.
Figure 3:
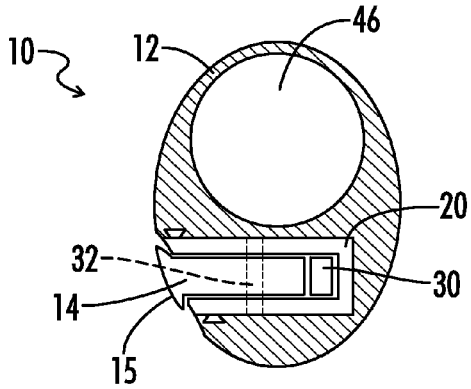
FIG. 3 is a cross-sectional view of an optional embodiment of a putter grip and blade assembly and a putter shaft.
Figure 4:
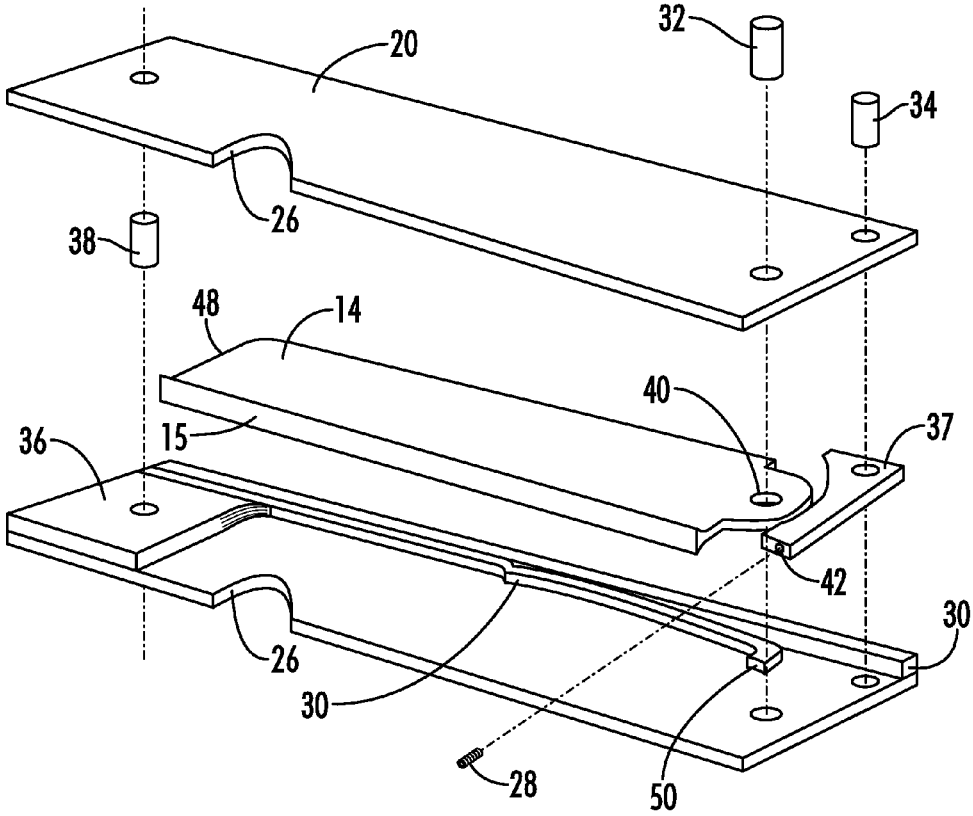
FIG. 4 is an exploded view of an optional embodiment of a putter grip and blade assembly.
Figure 5:
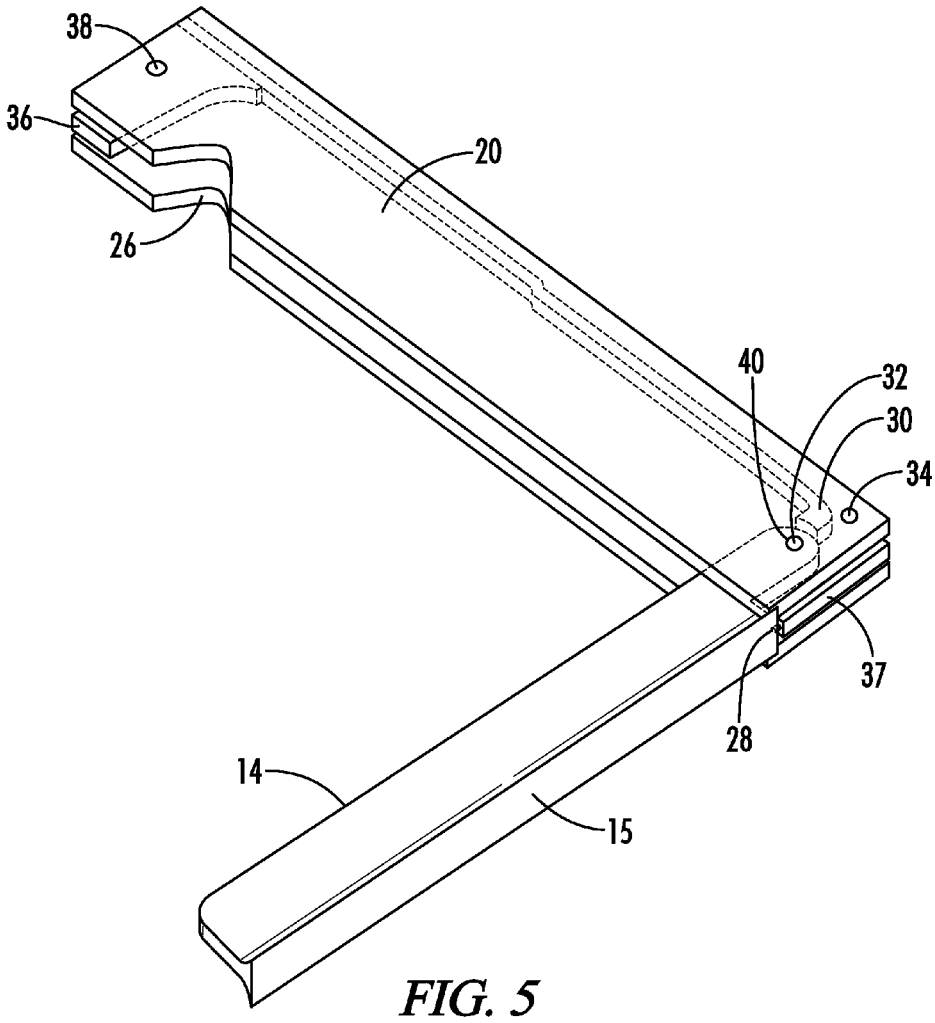
FIG. 5 is a view of an optional embodiment of a putter grip and blade assembly removed from the putter grip.

As shown in FIGS. 1-5 there are multiple optional embodiments of putter grip and blade assembly 10. This includes in optional embodiments grip 12 and blade 14. Grip 12 may generally comprise a rubberized or otherwise grippable surface having often a texture which may provide for an area to grip the putter while making a stroke with the club. The grip includes proximal end 13 with shaft opening 17 and distal end 19.

Blade 14 may comprise a variety of materials including polymers, plastics, metals, alloys, ceramics, synthetic and natural materials and combinations thereof in forming blade 14. In further optional embodiments not illustrated, blade 14 may comprise other geometric shapes including round, triangular, oval or the like and by no means are the shapes as provided in the illustration limiting in any regard. In further optional embodiments blade 14 may comprise a generally T-shaped cross-section.

In further optional embodiments, blade 14 may include markings for use in estimating the degrees of slope of a putting surface, the blade markings designated by numeral 16. In additional optional embodiments, grip markings 18 may be utilized on grip 12 to additionally provide for indication of the specific angle of blade 14 relative to grip 12.

Further embodiments may include either no markings utilized on blade 14 or in further embodiments markings used on both blade 14 and also grip 12.

Blade 14 is generally enclosed within an enclosure 20 which may be recessed in optional embodiments within grip 12 of putter grip and blade assembly 10. The recess generally runs parallel to an axis from the proximal end to the distal end of grip 12. Generally when blade 14 is in the closed position within enclosure 20, exposed blade surface 15 is the portion of blade 14 visible. In optional embodiments, the sides of blade 14 may be substantially within the enclosure, though may partially be exposed in further embodiments.

Additionally, exposed blade surface 15 may include a similar texture or rubberized treatment so as to provide a more uniform grip to that of putter grip surface 12. In further optional embodiments exposed blade surface 15 may generally comprise the same material and texture as the rest of blade 14.

In embodiments as illustrated of putter grip and blade assembly 10 of the present invention generally blade 14 rotates out of enclosure 20 about rotation pin 32. Enclosure 20 includes generally a top enclosure point 22 and bottom enclosure point 24 where in optional embodiments the blade affixes near bottom enclosure point 24 via rotation pin 32. In further optional embodiments, to provide the user with greater ease in manipulating the blade thumb notches 26 may be present anywhere on enclosure 20 so as to provide the user an area of blade 14 to grasp and rotate out of putter grip and blade assembly 10. In further optional embodiment, thumb notches 26 may be near to top enclosure point 22. Yet further, the location of rotation pin 32 may be opposite that as illustrated in the accompanying drawing and thus blade 14 could rotate upward.

Enclosure 20 may also include spacers 36 which generally provide space between the two horizontal sides of enclosure 20 so that blade 14 may fit therebetween the two long portions of enclosure 20. In optional embodiments, spacers 36 located at top enclosure point 22 may further comprise securement pin 34 for maintaining the spacer between the longer portions of enclosure 20 and similarly in optional embodiments securement pin 38 may be used to secure bottom spacer 36 located near rotation pin 32 which fits within rotational hole 40 of blade 14.

In further optional embodiments, bottom spacer 37 may include set screw opening 42 for set screw 28. Set screw 28 may be utilized to abut against blade heel 44 so that upon full extension of blade 14, blade 14 will align perpendicularly to shaft 46 with putter grip and blade assembly 10. In practice, set screw 28 may be positioned so as to extend from set screw opening 42 and thus would abut blade heel 44 causing the angle between blade top 48 and putter grip and blade assembly 10 to decrease. Conversely, by screwing set screw 28 further into set screw opening 42, set screw 28 will not abut blade heel 44 as soon and thus the angle of blade top 48 to putter grip and blade assembly 10 would relatively increase. In optional embodiments, blade 14 may be set at about perpendicular to the shaft and/or grip of the club. This may be otherwise understood to be a rotational limit of blade 14, where in optional embodiments, the blade may have a rotational limit of about 90 degrees.

Tension spring 30 may functions in optional embodiments of putter grip and blade assembly 10 to maintain blade 14 secure in a closed position. Tension spring 30 may include contact tab 50 which contacts blade 14 near the portion of blade 14 with blade heel 44 and rotation hole 14. Pressure on blade 14 to rotate blade 14 out of putter grip and blade assembly 10 requires overcoming the tension provided by tension spring 30. In further optional embodiments one or more tension springs may be utilized on each side of blade 14.

In yet further optional embodiments tension spring 30 may comprise a variety of different spring types including coil type springs arranged so as to maintain the blade in a closed fashion. Yet in further optional embodiments, tension spring 30 may be absent and thus blade 14 may be tightly fit to rotation pin 32 to provide for a relatively secure blade 14 within putter grip 12.

Generally blade 14 as well as enclosure 20 may be comprised of a variety of materials including metals, alloys, steel, stainless steel, graphite, polymers, plastics and the like. In forming the putter grip and blade assembly, grip 12 can be molded about enclosure 20 with the necessary hardware including blade 14 so that there is a lesser likelihood of separation of rubber with other materials the grip may be comprised of and the blade assembly. In further optional embodiments of the invention, an adhesive including glue, cement or other material may be utilized to affix the blade and necessary hardware within a putter grip. The putter grip may also include an opening specifically sized for the blade with enclosure providing optionally a pressure fit so that the blade assembly is removable but yet can be easily maintained within place. In such embodiments a user may decide to not use the blade assembly and thus remove it from the putter grip without having to change complete grips on the putter.

In further optional embodiments, blade 14 may have a thickness of from about 1/16 of an inch to about 1/4 of an inch or may be outside this range though would generally be the size so that it fits within the acceptable size of putter grips for putters. Generally the width of the enclosure holding the blade may be of from about 1/4 inch up to about 3/4 of an inch though may be slightly greater or smaller. Advantageously such break and necessary hardware may fit within the generally accepted sizes of putter grips. The markings on the blade may be etched on one or both sides or may further be applied by an adhesive or the like.

Figure 6:
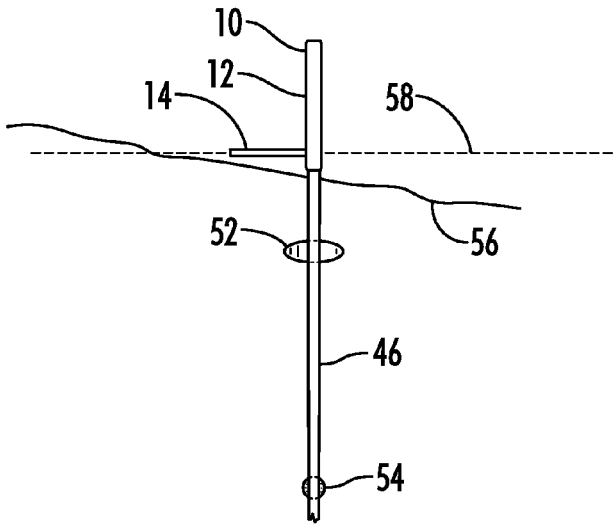
FIG. 6 is an illustration of an optional embodiment of a putter grip and blade assembly being used to assess the slope left or right on a putting green.
Figure 7:
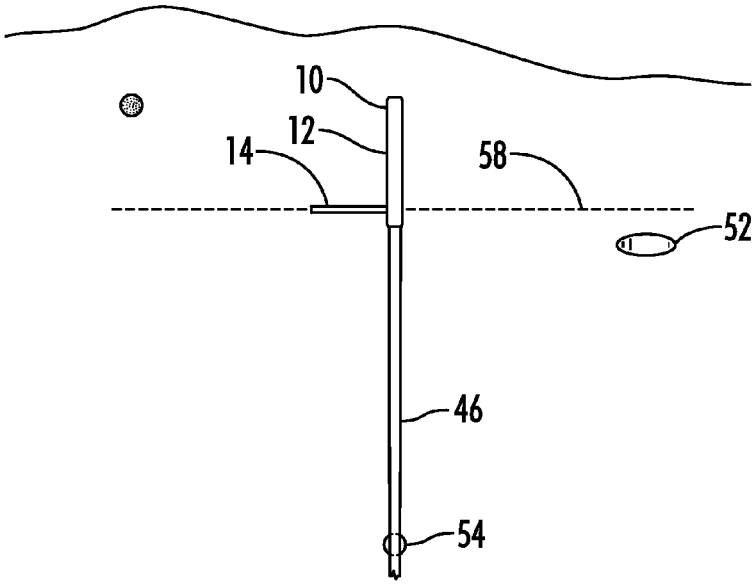
FIG. 7 is an illustration of an optional embodiment of a putter grip and blade assembly being used to evaluate the uphill or downhill slope of a golf ball from the hole on a putting green.

Now referring to FIGS. 6 and 7 there are illustrations of how putter grip and blade assembly 10 may be utilized on a putting green. As illustrated in FIG. 6 a golfer may line up golf ball 54 and hole 52 with putter shaft 46 and thus can use extended blade 14 to create reference line 58 and thus better approximate the degree of slope 56. In yet a further method of use, FIG. 7 illustrates how putter blade may be utilized to better predict whether the lie is uphill or downhill from the hole. In practice, a user may stand about perpendicular to the ball and hole and thus be able to determine whether or not the lie is uphill or downhill based upon the relative position of ball 54 and hole 52 in relation to reference line 58 created by blade 14 of putter grip and blade assembly 10. In further methods of use, an individual may maintain the putter blade as extended so as to provide a putting aid in keeping the putter face squared through the putting stroke.

In yet further optional embodiments, the blade may be integrated into the actual shaft of the putter. Additionally, the blade may be located anywhere on the entire length of the shaft and such earlier discussions do not preclude the blade from being located a distance away from the grip of the putter. As such, the shaft may be machined to have the putter blade fit there into. Optionally, the blade may be integrated into the shaft with the grip having an opening for the blade as well.

Furthermore, sizes of various structural parts and materials used to make the above mentioned components are illustrative and exemplary only, and persons of ordinary skill in the art will recognize that the sizes and materials can be changed as necessary to produce different results or different desired characteristics.

Referring to FIGS. 8-18, a putter blade assembly 10 includes a blade 14, a pin 32, and an outer body 20. The outer body 20 is sized to fit partially within a putter shaft 46 and engage an inside wall of the putter shaft 46 when installed in the putter shaft 46. The outer body 46 is substantially cylindrical with a portion that sticks out of the putter shaft 46 when the putter blade assembly 10 is installed in the putter shaft 46. In one embodiment, the outer body 46 is held to the inside wall of the putter shaft 46 via an adhesive when installed in the putter shaft 46.

The putter shaft 46 has a first end and a second end. The second end is opposite the first end with respect to a longitudinal axis 800 of the putter. A putter head 410 is connected to the first end of the putter shaft 46 (see FIG. 18), and the putter blade assembly 10 is installed in the second end of the putter shaft 46.

The pin 32 includes a pin shaft and a pin head. The pin shaft has a diameter, and the pin head has a diameter greater than the diameter of the pin shaft. The pin shaft attaches the pin head to the portion of the outer body 20 that stick out of the putter shaft 46 when the putter blade assembly 10 is installed in the putter shaft 46.

Figure 12:
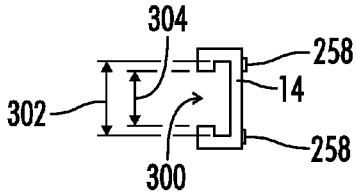
FIG. 12 is an end plan view of the blade of FIG. 8.
Figure 13:
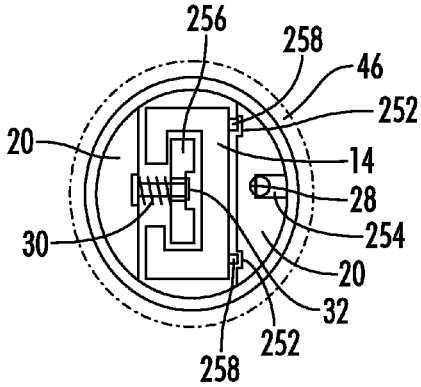
FIG. 13 is a top plan view of the blade assembly of FIG. 8.
Figure 14:
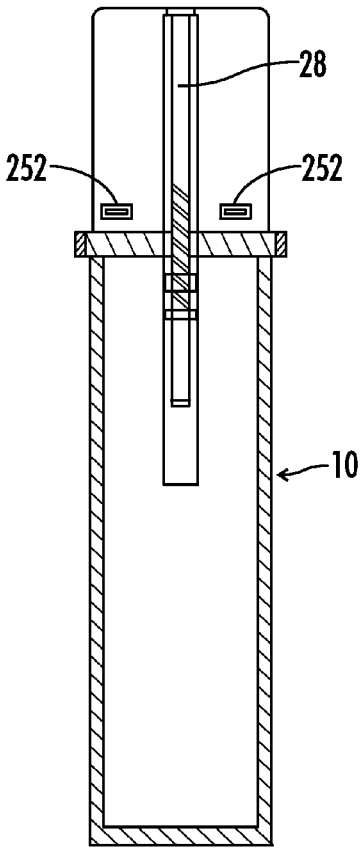
FIG. 14 is a front cutaway plan view of the blade assembly of FIG. 8.
Figure 15:
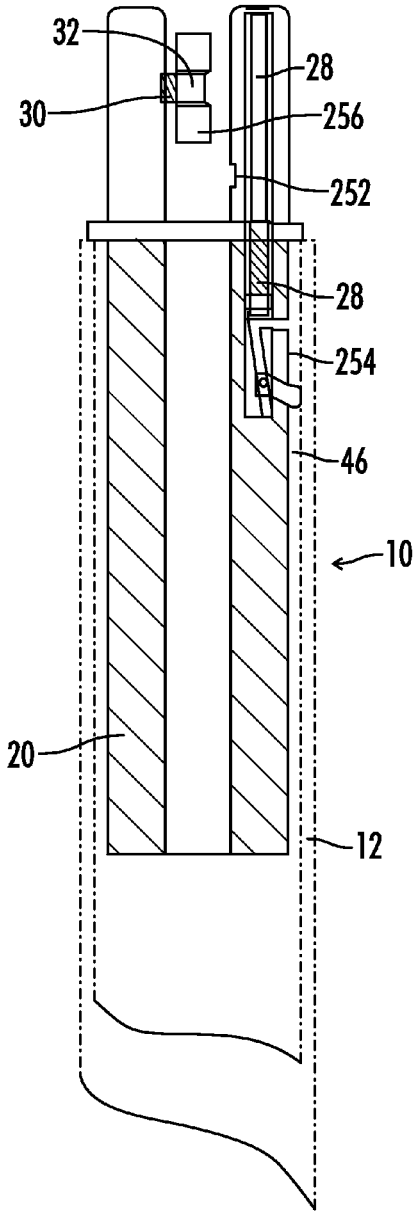
FIG. 15 is a side cutaway plan view of the blade assembly of FIG. 8.
Figure 16:
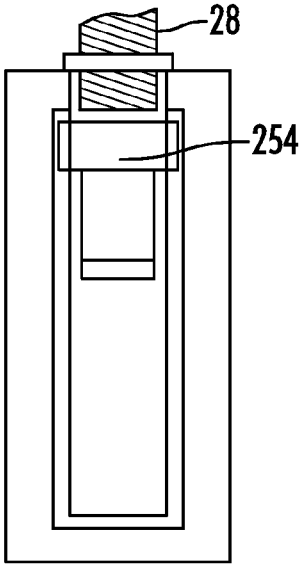
FIG. 16 is a front cutaway plan view of a set screw assembly of the blade assembly of FIG. 8.
Figure 17:
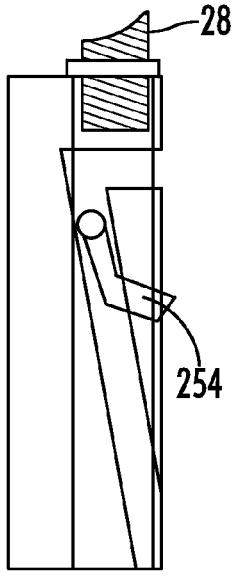
FIG. 17 is a side cutaway plan view of the set screw assembly of the blade assembly of FIG. 16.
Figure 18:
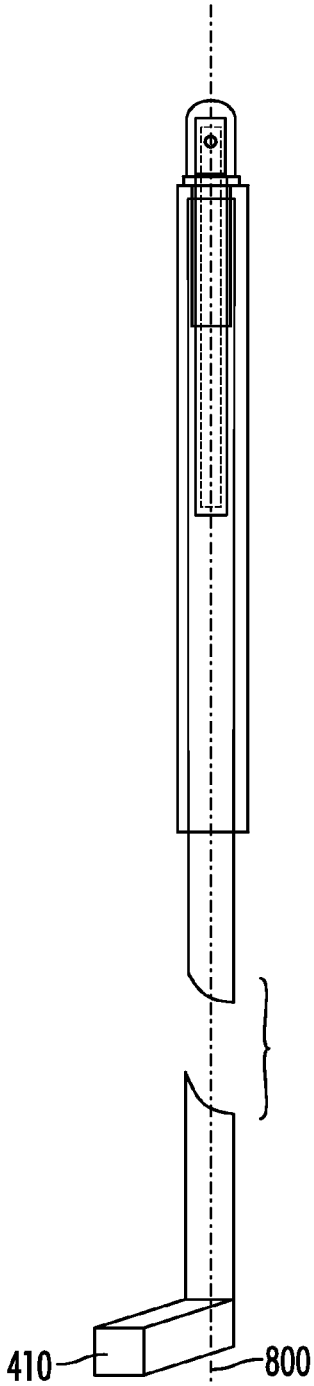
FIG. 18 is a front plan view of a putter including the blade assembly of FIG. 8.

The blade 14 has a channel 300 (see FIG. 12). The channel 300 has a first width 302 and a second width 304, and the second width 304 is less than the first width 302 such that a cross section of the blade 14 appears to have ears (i.e., is C shaped) instead of being substantially V shaped. The first width 302 is sized to receive the pin head, and the second width 304 is sized to receive the pin shaft. The second width 304 is less than the diameter of the pin head such that when the blade 14 is slid over the pin head during assembly, the blade 14 becomes affixed to the pin 32, and thus the outer body 20 to which the pin 32 is connected.

Figure 8:
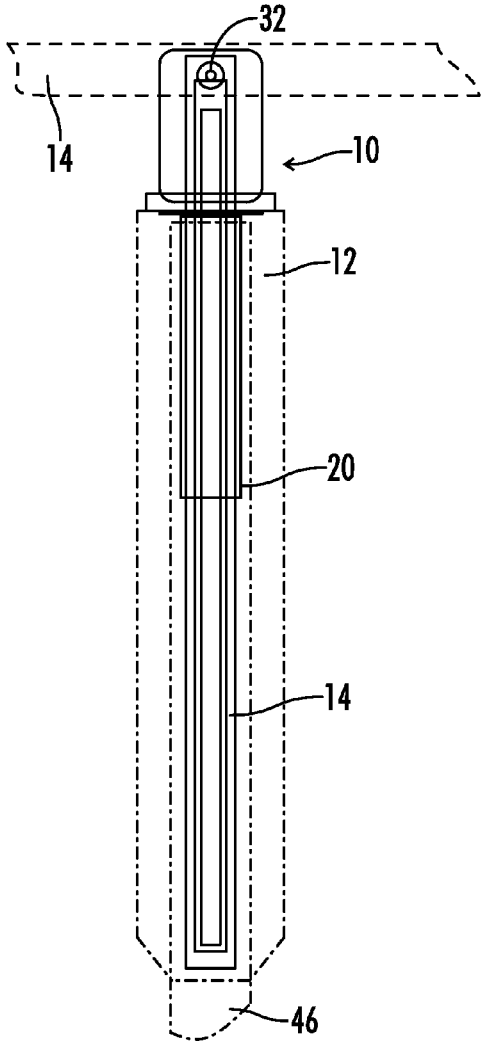
FIG. 8 is a side cutaway plan view of a blade assembly in a putter shaft.
Figure 9:
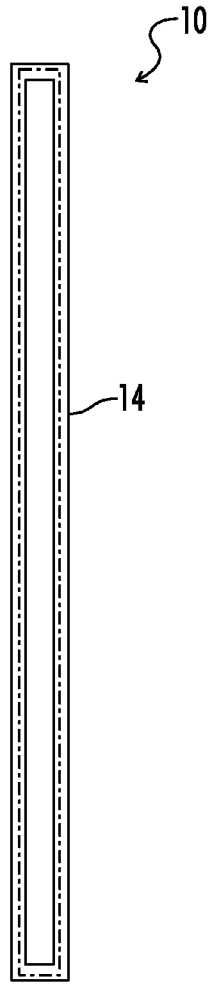
FIG. 9 is a front plan view of the blade of FIG. 8.
Figure 10:
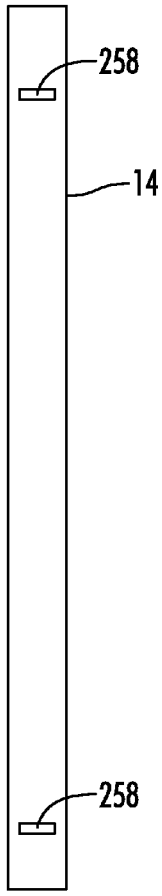
FIG. 10 is a back plan view of the blade of FIG. 8.
Figure 11:
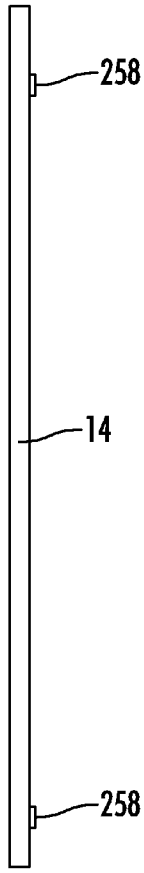
FIG. 11 is a side plan view of the blade of FIG. 8.

The blade 14 has a first position and a second position (see FIG. 8). In the first position, the blade 14 extends into the outer body 20 and the putter shaft 46. In one embodiment, the blade 14 extends into the putter shaft 46 beyond the outer body 20. The first position is the stowed position shown in, for example, FIGS. 8, 13, and 18. The dashed lines of FIG. 8 show where the blade 14 would be in the second position. In the second position, the blade 14 is supported by the pin 32 and outer body 20 at an angle between about 15 and 165 degrees with respect to the longitudinal axis 800 of the putter shaft 46. In order to move the blade 14 from the first position to the second position, a user pulls the blade 14 along the longitudinal axis 800 to expose the blade 14 and then rotates the blade 14 about the pin 32 into the second position. In one embodiment, the pin head includes a rotational rectangular washer 256 that fits into the channel 300, interlocking with the blade 14 and rotating about the pin shaft. In one embodiment, the pin 32 also includes a tension spring 30 positioned coaxially with the pin shaft to bias the rotational rectangular washer 256 away from the portion of the outer body 20 where the pin 32 is attached to the outer body 20. The tension spring 30 thus produces a friction essentially between the outer body 20 and the blade 14 to hold the blade 14 at any angle with respect to the longitudinal axis of 800 of the putter shaft 46. In one embodiment, the pin 32 and outer body 20 cooperate to hold the blade 14 at a default position or default angle such as perpendicular to the longitudinal axis 800 via a detent.

In one embodiment, the blade 14 further comprises at least one tab 258 extending from a face of the blade 14 opposite the channel 300. At least one corresponding indentation 252 in the outer body 20 cooperates with the tab 258 to maintain the blade 14 in the first position. The tension spring 30 biases the tab 258 and indentation 252 into engagement. Alternatively, the outer body 20 has at least one tab, and the blade 14 has at least one corresponding indentation.

In one embodiment, the outer body 20 is held in or attached to the putter shaft 46 via friction or a wedge action of a set screw 28 forcing a locking flange 254 against the inside wall of the putter shaft 46. A first portion of the locking flange 254 extends substantially radially toward the longitudinal axis 800 of the outer body 20. A second portion of the locking flange 254 extends substantially parallel to the longitudinal axis 800. The locking flange 254 is pivotally attached to the outer body 20 at the junction between the first portion of the locking flange 254 and the second portion of the locking flange 254. The set screw 28 extends substantially parallel to the longitudinal axis 800 and exerts pressure on the first portion of the locking flange 254, which forces the second portion of the locking flange 254 radially outward from the outer body 20 and against the inside wall of the putter shaft 46. In one embodiment, the outer body 20 further includes a collar operable to engage a rim of the putter shaft 46 or grip in order to prevent the blade assembly 10 from falling into the putter shaft 46 during installation.

It would have become apparent to those skilled in the art that various modifications and variations can be made to the structure and methodology of the present invention. Thus, it should be understood that the invention is not limited to the examples described in the specification. Rather, the present invention is intended to cover modifications and variations.

Thus, although there have been described particular embodiments of the present invention of a new and useful Putter Grip For Reading A Golf Green it is not intended that such references be construed as limitations upon the scope of this invention except as set forth in the following claims.

What is claimed is:

1. A putter blade assembly operably installed within a putter shaft, said putter blade assembly comprising:

an outer body sized to fit at least partially within the putter shaft and engage an inside wall of the putter shaft when installed in the putter shaft;

a pin having a pin shaft and a pin head, wherein the pin shaft has a diameter, the pin head has a diameter, and the diameter of the pin head is greater than the diameter of the pin shaft, and wherein the pin shaft is attached between the outer body and the pin head; and a blade having a channel, said channel having a first width sized to receive the pin head, and a second width sized to receive the pin shaft, wherein the second width is less than the diameter of the pin head, wherein:

the blade has a first position and a second position;

in the first position, the blade extends into the outer body and the putter shaft, substantially parallel to a longitudinal axis of the putter shaft;

in the second position, the outer body and pin support the blade at an angle between 15 and 165 degrees to the longitudinal axis of the putter shaft.

2. The putter blade assembly of claim 1, wherein the pin head comprises a rotational rectangular washer operable to engage the blade within the channel of the blade and rotate about the pin shaft.

3. The putter blade assembly of claim 1 wherein the pin head comprises a rotational rectangular washer operable to engage the blade within the channel of the blade and rotate about the pin shaft, and the blade assembly further comprises a tension spring positioned coaxially with the pin shaft operable to bias the rotational rectangular washer away from a portion of the outer body adjacent the pin shaft to which the pin shaft is attached.

4. The putter blade assembly of claim 1, wherein the blade further comprises a tab, and the outer body further comprises an indentation, wherein the indentation is operable to receive the tab when the blade is in the first position such that the indentation and tab cooperate to maintain the blade in the first position.

5. The putter blade assembly of claim 1, wherein the outer body further comprises a tab, and the blade comprises an indentation, wherein the indentation is operable to receive the tab when the blade is in the first position such that the indentation and tab cooperate to maintain the blade in the first position.

6. The putter blade assembly of claim 1 wherein the pin head comprises a rotational rectangular washer operable to engage the blade within the channel of the blade and rotate about the pin shaft, and the blade assembly further comprises a tension spring positioned coaxially with the pin shaft operable to bias the rotational rectangular washer away from a portion of the outer body adjacent the pin shaft to which the pin shaft is attached such that when the blade is in the second position, the outer body and pin cooperate to maintain the blade at any angle between about 15 and 165 degrees to the longitudinal axis of the putter shaft.

7. The putter blade assembly of claim 1, wherein the outer body and pin cooperate to support the blade in a default position, wherein the default position is substantially perpendicular to the putter shaft.

8. The putter blade assembly of claim 1, wherein the outer body is operable to be affixed to the inside face of the putter shaft via an adhesive.

9. The putter blade assembly of claim 1, further comprising:

a locking flange having a first portion extending substantially radially toward a longitudinal axis of the outer body, and a second portion extending substantially parallel to the longitudinal axis of the outer body, wherein the locking flange is operable to pivotally engage the outer body between the first portion and the second portion of the locking flange; and a set screw operable to extend substantially parallel to the longitudinal axis of the outer body and engage the first portion of the locking flange such that when the set screw is advanced into the outer body, the set screw engages the first portion of the locking flange, forcing the second portion of the locking flange to extend radially from the outer body.

10. A putter comprising:

a putter shaft having a longitudinal axis and an inside wall;

a putter head connected to a first end of the putter shaft;

a putter blade assembly connected to a second end of the putter shaft, said putter blade assembly comprising:

an outer body fit at least partially within the putter shaft and engaging the inside wall of the putter shaft;

a pin having a pin shaft and a pin head, wherein the pin shaft has a diameter, the pin head has a diameter, and the diameter of the pin head is greater than the diameter of the pin shaft, and wherein the pin shaft is attached between the outer body and the pin head; and a blade having a channel, said channel having a first width sized to receive the pin head, and a second width sized to receive the pin shaft, wherein the second width is less than the diameter of the pin head, wherein:

the blade has a first position and a second position;

in the first position, the blade extends into the outer body and the putter shaft, substantially parallel to the longitudinal axis of the putter shaft;

in the second position, the outer body and pin support the blade at an angle between 15 and 165 degrees to the longitudinal axis of the putter shaft.

11. The putter of claim 10, wherein the pin head comprises a rotational rectangular washer operable to engage the blade within the channel of the blade and rotate about the pin shaft.

12. The putter of claim 10 wherein the pin head comprises a rotational rectangular washer operable to engage the blade within the channel of the blade and rotate about the pin shaft, and the blade assembly further comprises a tension spring positioned coaxially with the pin shaft operable to bias the rotational rectangular washer away from a portion of the outer body adjacent the pin shaft to which the pin shaft is attached.

13. The putter of claim 10, wherein the blade further comprises a tab, and the outer body further comprises an indentation, wherein the indentation is operable to receive the tab when the blade is in the first position such that the indentation and tab cooperate to maintain the blade in the first position.

14. The putter of claim 10 wherein the outer body further comprises a tab, and the blade comprises an indentation, wherein the indentation is operable to receive the tab when the blade is in the first position such that the indentation and tab cooperate to maintain the blade in the first position.

15. The putter of claim 10 wherein the pin head comprises a rotational rectangular washer operable to engage the blade within the channel of the blade and rotate about the pin shaft, and the blade assembly further comprises a tension spring positioned coaxially with the pin shaft operable to bias the rotational rectangular washer away from a portion of the outer body adjacent the pin shaft to which the pin shaft is attached such that when the blade is in the second position, the outer body and pin cooperate to maintain the blade at any angle between about 15 and 165 degrees to the longitudinal axis of the putter shaft.

16. The putter of claim 10, wherein the outer body and pin cooperate to support the blade in a default position, wherein the default position is substantially perpendicular to the longitudinal axis of the putter shaft.

17. The putter of claim 10, wherein the outer body is affixed to the inside face of the putter shaft via an adhesive.

18. The putter of claim 10, wherein the putter blade assembly further comprises:

a locking flange having a first portion extending substantially radially toward a longitudinal axis of the outer body, and a second portion extending substantially parallel to the longitudinal axis of the outer body, wherein the locking flange is operable to pivotally engage the outer body between the first portion and the second portion of the locking flange; and a set screw operable to extend substantially parallel to the longitudinal axis of the outer body and engage the first portion of the locking flange such that when the set screw is advanced into the outer body, the set screw engages the first portion of the locking flange, forcing the second portion of the locking flange to extend radially from the outer body.

19. A method of reading the contours of a putting green comprising the steps of:

establishing a position of a golf ball;

establishing a position of a cup;

aligning oneself relative to the position of the golf ball and cup;

providing a putter comprising:

a putter shaft having a longitudinal axis and an inside wall;

a putter head connected to a first end of the putter shaft;

a putter blade assembly connected to a second end of the putter shaft, said putter blade assembly comprising:

an outer body fit at least partially within the putter shaft and engaging the inside wall of the putter shaft;

a pin having a pin shaft and a pin head, wherein the pin shaft has a diameter, the pin head has a diameter, and the diameter of the pin head is greater than the diameter of the pin shaft, and wherein the pin shaft is attached between the outer body and the pin head; and a blade having a channel, said channel having a first width sized to receive the pin head, and a second width sized to receive the pin shaft, wherein the second width is less than the diameter of the pin head, wherein:

the blade has a first position and a second position;

in the first position, the blade extends into the outer body and the putter shaft, substantially parallel to the longitudinal axis of the putter shaft;

in the second position, the outer body and pin support the blade at an angle between 15 and 165 degrees to the longitudinal axis of the putter shaft;

moving the blade to the second position; and viewing the blade with the green to read the contours of the green.

* * * * *